US005466554A

United States Patent [19]

Sacripante et al.

[11] Patent Number: 5,466,554

[45] Date of Patent: Nov. 14, 1995

[54] TONER COMPOSITIONS WITH MODIFIED POLYESTER RESINS

[75] Inventors: Guerino G. Sacripante, Oakville; Richard P. N. Veregin, Mississauga; Maria N. V. McDougall, Burlington, all of Canada

[73] Assignee: Xerox Corporation, Stamford, Conn.

[21] Appl. No.: 251,430

[22] Filed: May 31, 1994

[51] Int. Cl.[6] ..... G03G 9/087; G03G 9/097

[52] U.S. Cl. ..... 430/110; 430/109

[58] Field of Search ..... 430/109, 110

[56] References Cited

U.S. PATENT DOCUMENTS

| | | | |
|---|---|---|---|
| 3,590,000 | 6/1971 | Palermiti et al. . | |
| 4,525,445 | 6/1985 | DeRoo et al. | 430/109 |
| 4,601,966 | 7/1986 | Grashof et al. | 430/109 |
| 4,876,169 | 10/1989 | Gruber et al. | 430/110 |
| 4,940,644 | 7/1990 | Matsubara et al. | 430/109 |
| 4,957,774 | 9/1990 | Doi et al. | 427/45.1 |
| 5,047,305 | 9/1991 | Uchida et al. | 430/110 |

FOREIGN PATENT DOCUMENTS

| | | | |
|---|---|---|---|
| 0469752 | 2/1992 | European Pat. Off. | 430/109 |
| 308175 | 12/1990 | Japan | 430/109 |

*Primary Examiner*—Roland Martin
*Attorney, Agent, or Firm*—E. O. Palazzo

[57] ABSTRACT

A toner composition comprised of pigment, an optional charge enhancing additive, optional wax, and a polyester resin containing a hydrophobic end group, which polyester is free of acid end groups and is of the formula

I

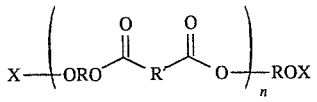

or

II

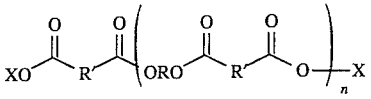

wherein R is an alkyl group, an alkyloxylated bisphenol, or a cyclohexyl; R' is an aryl group, an olefinic group, or an alkyl group; X is a silane, a siloxane, or a halogenated hydrocarbon; and n represents the number of segments.

21 Claims, No Drawings

TONER COMPOSITIONS WITH MODIFIED POLYESTER RESINS

BACKGROUND OF THE INVENTION

The invention is generally directed to toner and developer compositions, and more specifically, the present invention is directed to developer and toner compositions containing polyester resins wherein the end groups of the polyester resin are modified with hydrophobic groups, which for example impart or assist in imparting a lower relative humidity sensitivity to the toner particles and enable toners with rapid admix characteristics. In embodiments, there are provided in accordance with the present invention toner compositions comprised of resin particles, pigment particles, and a polyester resin free of acid end groups and containing a hydrophobic end group, or groups, such as a siloxane, a fluorocarbon or halogenated hydrocarbon, which groups impart or assist in imparting a low relative humidity sensitivity, such as from about 1.0 to about 2.5 to the toner particles, and enable toners with rapid admix characteristics, such as less than 60 seconds. More specifically, in embodiments of the present invention, there is provided a toner comprised of pigment particles and a polyester resin containing end groups, and wherein the polyester is illustrated by the following Formulas I, II, or mixtures thereof in embodiments

I

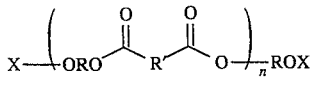

II

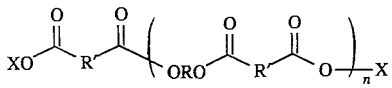

wherein R is an aliphatic, especially alkylene, group such as a hydrocarbon with from about 2 to about 45 carbon atoms, an alkyleneoxylated bisphenol, especially bisphenol A such as propyloxylated bisphenol A, cycloalkylene like a cyclohexylene, such as 1,4-dimethyl cyclohexylene; R' is an arylene with, for example, from 6 to about 30 carbon atoms group such as isophthalylene, terephthalylene or phthaloylene, an olefinic group such as vinylene, methylvinylene, or an aliphatic hydrocarbon such as alkylene like ethylene, propylene, butylene, penylene, hexylene, and the like; X represents the hydrophobic end group, such as a silane like a trimethylsilyl, triethylsilyl, or siloxane, such as dimethylsiloxane of weight average molecular weight of from about 200 to about 20,000 grams per mole, or a fluorinated hydrocarbon with, for example, from 1 to about 45 carbon atoms, such as trifluoromethyl, pentafluorethyl or octafluorpentyl, or other halogenated hydrocarbon such as tribromomethyl, chlorohexyl, the corresponding alkyl halogenated fluorinated hydrocarbons, and the like; and n represents the number of repeating segments.

The aforementioned toner compositions and developers thereof, that is the toner mixed with a carrier, display in embodiments a low relative humidity sensitivity for the toners thereof, which is desired, thus the triboelectric charge is stable to changes in environmental humidity conditions. Copiers and printers equipped with two component developers, that is a toner as one component mixed with the carrier as the other component, can exhibit a positive or negative triboelectric charge with a magnitude of from, for example, about 7 microcoulombs per gram to about 40 microcoulombs per grams. This triboelectric charge permits the toner particles to be transferred to the latent image of the photoreceptor with an opposite charge, thereby forming a toned image on the photoreceptor, which is subsequently transferred to a paper or a transparency substrate, and thereafter subjected to fusing or fixing process. In these development systems, it is important for the triboelectric charge to be stable under differing environmental humidity conditions such that the triboelectric charge does not change by more than from about 5 to about 10 microcoulombs per gram. A change of more than from about 5 microcoulombs per gram to about 10 microcoulombs per gram in triboelectric charge of the toner developer can cause nonuniform toned images or result in no toning of the photoreceptor, thus unbalanced density or gray scale is observed in the developed images, or no developed images at all result. Generally, humidity ranges may differ from less than about 20 percent in dry regions to more than about 80 percent in humid regions, and some geographical regions may exhibit fluctuations of up to from about 50 to about 80 percent humidity level within the same day. In such climates, it is important that the developmental triboelectric charge does not change by more than from about 5 microcoulombs per gram to about 10 microcoulombs per gram. As toner resins generally represent from about 80 percent to about 98 percent by weight of the toner, the resin sensitivity to moisture or humidity conditions should be minimized thereby not adversely affecting the triboelectric charge thereof. A number of toner polymeric resins utilized as toner compositions, such as for example styrene-acrylates, styrene-methacrylates, styrene-butadienes, and especially polyesters, contain from about 0.1 to about 2 percent by weight of moisture, and in some instances, the moisture content of polyesters may change from about 0.1 to about 4 percent by weight at humidity levels ranging from about 0 to about 100 percent, or preferably from about 20 percent to about 80 percent humidity. These changes in moisture content of the resin may have a dramatic adverse effect on the triboelectric charge of the toner developer. The relative humidity sensitivity of toner is customarily measured by first fabricating a toner comprised of a pigment, optional charge control agent and a resin, then admixing the toner from about 3 percent by weight to about 7 percent by weight with a carrier. The developer composition is then subjected to various humidity levels in a sealed chamber for a finite period of time, such as about 48 hours. The triboelectric charge is then measured for the same developer composition at differing humidity levels and analyzed by several methods, such as graphing the triboelectric charge as a function of humidity level and observing the regions in which dramatic changes occur. Another measuring method comprises dividing the aforementioned graphical interpolation of tribo versus humidity level in three regions, wherein region I is from about 0 to about 30 percent humidity, region II is from about 30 to about 65 percent humidity, and region III is higher than about 65 percent humidity to about 100 percent humidity. Since these measurements are cumbersome and require substantial time, the toner triboelectric charge can be measured after subjecting the toner developer composition to two humidity levels, such as 20 percent humidity and 80 percent humidity, and then calculating the relative sensitivity by taking the triboelectric charge ratio of the 20 to 80 percent humidity as given by the following Equation 1:

$$\text{Relative Humidity Sensitivity} = \frac{\text{Tribo Charge at 20\% RH}}{\text{Tribo Charge at 20\% RH}}$$

wherein RH is the relative humidity.

Thus, if the relative sensitivity is about 1.0, the toner composition is considered nonhumidity sensitive, whereas if the relative sensitivity is greater than from about 3, or greater than about 5, the toner composition is considered to be very humidity sensitive. It is generally believed that a number of polymeric materials exhibit relative sensitivity greater than 1.0, and in general, styrene butadiene, or styrene acrylate possess relative humidity sensitivity of greater than 1.0 and less than about 2.5, whereas polyesters generally possess a relative humidity sensitivity of greater than about 2.5 and less than about 5. Hence, an advantage of the styrene-acrylate or styrene-butadiene class of resins over polyesters is their lower relative sensitivity. Polyesters are known to display advantages over styrene based resins, such as low fixing temperatures of from about 120° C. to about 140° C., high gloss, such as from about 50 gloss units to about 80 gloss units, and nonvinyl offset properties. Therefore, there is a need for toner compositions comprised of a resin which possess many of the aforementioned advantages, such as low fixing of from about 120° C. to about 140° C., a high gloss, such as from about 50 gloss units to about 80 gloss units, nonvinyl offset properties, and in addition low relative humidity sensitivity, such as from about 1.0 to about 2.5. These and other advantages are attained in embodiments with the toner compositions of the present invention comprised of a pigment, optionally a charge control agent, and a modified polyester resin wherein the end groups are hydrophobic, and which toners exhibit low fixing of from about 120° C. to about 140° C., high gloss, such as from about 50 gloss units to about 80 gloss units, nonvinyl offset properties, and low relative humidity sensitivity, such as from about 1.0 to about 2.5.

Also, the aforementioned toner compositions usually contain pigment particles comprised of, for example, carbon black like REGAL 330®, magnetites, or mixtures thereof, cyan, magenta, yellow, blue, green, red, or brown components, or mixtures thereof thereby providing for the development and generation of black and/or colored images. The toner compositions of the present invention in embodiments thereof possess excellent admix characteristics as indicated herein, and maintain their triboelectric charging characteristics for an extended number of imaging cycles, up to for example 1,000,000 in a number of embodiments. The toner and developer compositions of the present invention can be selected for electrophotographic, especially xerographic, imaging and printing processes, including color processes.

There is also a need for toner compositions which possess desired triboelectric charge levels of, for example, from about 10 to about 40 microcoulombs per gram, and preferably from about 10 to about 25 microcoulombs per gram, and admix charging rates of from about 5 to about 60 seconds, and preferably from about about 15 to about 30 seconds, as determined by the charge spectrograph. There is also a need for low relative humidity toners, such as from about 1.0 to about 2.5 and preferably of from about 1.2 to about 2.2, as calculated by Equation 1, and wherein low minimum fixing temperatures are obtained such as from about 125° C. to about 145° C. with a broad fusing latitude such as from about 30° C. to about 45° C. These and other needs are achievable with the toners of the present invention.

Certain polyester toner resins are known, reference for example in U.S. Pat. Nos. 3,590,000 and 4,525,445, which illustrate a linear polyester comprised preferably of propoxylated bisphenol A and fumaric acid, and available as SPAR II™ from a number of sources such as Atlas Chemical Company. There is also disclosed in Japanese Patent Laid Open 44836 (1975), 37353 (1982), 109875 (1982) and 3031858-A (1991) and references therein, a linear polyester resin comprised of polybasic carboxylic acid, such as those derived from ethoxylated bisphenol A, cyclohexanedimethanol and terephthalic acid. Further, there is disclosed in U.S. Pat. No. 4,533,614, and, more specifically, U.S. Pat. No. 4,957,774 a linear polyester resin comprised of dodecylsuccinic anhydride, terephthalic acid, alkyloxylated bisphenol A and trimellitic anhydride as chain extenders.

Additionally, there is disclosed in U.S. Pat. No. 4,940,644, U.S. Pat. No. 5,047,305, U.S. Pat. No. 4,049,447, and Canadian Patent 1,032,804 a linear polyester comprised of an amorphous aromatic polyester derived from an arylene radical and diol, and specifically resins such as poly(neopentyl-terephthalate) comprised of terephthalate radical and neopentyl glycol. Also, there is disclosed in U.S. Pat. No. 4,525,445 a toner composition comprised of a linear polyester derived from fumaric acid, isophthalic acid and propoxylated bisphenol. Further, other toner compositions are known to contain linear polyester resins, such as those disclosed in U.S. Pat. No. 4,968,575 and U.S. Pat. No. 5,004,664, a linear polyester prepared from the ring opening polymerization of cyclic monomers, and U.S. Pat. No. 5,057,392, which discloses a blend of resins comprised of a crystalline and amorphous polyesters; and U.S. Pat. Nos. 4,543,313 and 4,891,293 wherein there are disclosed linear thermotropic liquid crystalline polyester resins. Other U.S. Patents relating to polyesters are U.S. Pat. Nos. 4,052,325; 3,998,747; 3,909,482; 4,4049,447; 4,288,516; 4,140,644; 4,489.150; 4,478,423; 4,451,837; 4,446,302; 4,416,965; 4,866,158; 5,153,301; 5,116,713; 5,043,242; 5,045,424; 5,049;646; 5,102,762; 5,110,977 and 4,837,394.

Developer compositions containing modified polyester resins with a polybasic carboxylic acid are known and illustrated in Japanese Laid Open Nos. 44836 (1975); 37353 (1982) and 109875 (1982); and also in U.S. Pat. No. 3,681,106, and branched or crosslinked polyesters derived from polyvalent acids or alcohols are illustrated in U.S. Pat. Nos. 4,298,672; 4,863,825; 4,863,824; 4,845,006; 4,814,249; 4,693,952; 4,657,837; 5,143,809; 5,057,596; 4,988,794; 4,981,939; 4,980,448; 4,960,664; 4,933,252; 4,931,370; 4,917,983 and 4,973,539. The resulting modified polyester resins by branching or crosslinking improve the hot-offset resistance only at a sacrifice of the low fixing temperature performance. In several of the aforementioned prior art references, there are disclosed polyester resins wherein the end groups are either an acid group, wherein acid numbers are reported, or hydroxyl groups. Therefore, the polyester ends are hydrophilic and possess poor relative humidity sensitivity, such as from about 3.5 to about 4.5, and different from those of the present invention wherein the polyester resins are modified to be comprised of hydrophobic end groups such as silanes, siloxanes, fluorocarbons or other halogenated carbons, and the acid content is avoided and not present, hence good to excellent relative humidity sensitivity are obtained such as from about 1.2 to about 2.5. The modification of the polyester end groups to hydrophobic types reduces the relative humidity sensitivity of the resulting toners while still retaining the favorable low fixing temperatures, such as from about 125° C. to about 145° C., and broad fusing latitude, as well as excellent admix such as about 60 seconds or less.

The modification of polyester resins based on terephthalates, such as described in the U.S. Pat. No. 5,391,452, results in polyesters that contain a hydrophobic end group which reduces the relative humidity of from about 2.8 (Comparative Example I) to about 1.8 (Example II) or to about 1.5 (Example III). Furthermore, there is also illustrated in the copending application that the modification of propoxylated bisphenol A based polyester toners reduces the relative humidity of from about 3.5 (Comparative Example IV) to about 2.1 (Example V).

Also, there is illustrated in U.S. Pat. No. 5,366,841, a toner comprised of pigment particles, optionally a charge control agent, and a polyester resin comprised of alkyl end groups, and wherein excellent dispersibility with waxes is disclosed.

Illustrated in U.S. Pat. No. 5,407,772 is an unsaturated linear polymer comprising: a reaction product comprising first residues of a first monomer, second residues of a second monomer and third residues of a third monomer, said first monomer being a diol having a molecular weight below about 200, said second monomer being selected from the group consisting of dicarboxylic acids and diesters, and said third monomer being different from said second monomer and selected from the group consisting of aromatic dicarboxylic acids and diesters; a concentration of said second residues ranging from about 3 to about 15 wt. %, based on a total weight of the polymer, and a concentration of said third residues ranging from about 40 to about 50 wt. % based on a total weight of the polymer; said polymer having a glass transition temperature ranging from about 52° C. to about 61° C.; U.S. Pat. No. 5,354,840 is a functional-amine polyester polymer comprising at least a first residue of a first monomer, a second residue of a second monomer and from about 0.1 to about 10.0 mole percent of a functional-amine residue of a functional amine, said polyester polymer being prepared by reacting the first and second monomers and the functional amine in an inert atmosphere, the functional amine having a functional group to facilitate polymerizing the functional amine and the first and second monomers, the functional-amine residue facilitating reaction of the functional-amine polyester in an organic peroxide crosslinking reaction system; and U.S. Ser. No. 100,937 now abandoned is a polyester resin having a monofunctional, unsaturated end group located on at least one end of the polyester chain.

SUMMARY OF THE INVENTION

It is an object of the present invention to provide toner and developer compositions wherein the polymeric resin contains a hydrophobic end group.

In another object of the present invention there are provided negatively or positively charged toner compositions useful for the development of electrostatic latent images including color images.

In yet another object of the present invention there are provided negatively charged toner compositions containing polyester with hydrophobic end groups, such as a silane, a siloxane, a halogenated hydrocarbon, and the like.

Also, in another object of the present invention there are provided developer compositions with negatively charged toner particles, and carrier particles.

In yet a further object of the present invention there are provided low humidity sensitive toners, such as for example from about 1.1 to about 2.5.

Also, in yet another objective of the present invention there are provided low humidity sensitive toners, such as for example from about 1.1 to about 2.5, with desirable admix properties of 5 seconds to 60 seconds as determined by the charge spectrograph, and preferably less than 15 seconds, for example, and more preferably from about 1 to about 14 seconds, and acceptable triboelectric charging characteristics of from about 10 to about 40 microcoulombs per gram.

Moreover, in another objective of the present invention there are provided low humidity sensitive toners with low minimum fixing temperatures, such as from about 125° C. to about 145° C., and which toners contain modified polyesters with end group functionalities of organofluorinated, or siloxy, and the like; or wherein acid/ester end groups are avoided by careful monomer selection.

Also, in yet another objective of the present invention there are provided low humidity sensitive toners with broad fusing latitude, such as from about 30° C. to about 45° C.

Furthermore, in yet another object of the present invention there are provided toner and developer compositions that are useful in a variety of electrostatic imaging and printing processes, including color xerography, and wherein the admix charging times are less than or equal to about 60 seconds.

Another object of the present invention resides in the formation of toners which will enable the development of images in electrophotographic imaging apparatuses, which images have substantially no background deposits thereon, are substantially smudge proof or smudge resistant, and, therefore, are of excellent resolution; and further, such toner compositions can be selected for high speed electrophotographic apparatuses, that is those exceeding 70 copies per minute.

These and other objects of the present invention can be accomplished in embodiments thereof by providing toner compositions comprised of pigment particles, and a polyester resin wherein the end groups are hydrophobic. More specifically, the present invention in embodiments is directed to toner compositions comprised of resin, pigment, or dye, and a polyester having chemically attached thereto end groups, such as a silane like an alkyl silane, such as trimethylsilane, tributyl silane, or t-butyldimethylsilane, a siloxane like alkyldimethylsiloxane, a fluorocarbon like trifluoroacetate, or a halogenated aliphatic hydrocarbon like tribromomethane or chlorohexane, mixtures thereof, and the like. Advantages of low humidity sensitivity, rapid admix, appropriate triboelectric characteristics, and the like are achieved with many of the aforementioned toners of the present invention.

The toner compositions of the present invention can be prepared by a number of known methods, such as admixing and heating the polyester resin, a charge enhancing agent, pigment particles, such as magnetite, carbon black, or mixtures thereof, and preferably from about 0.5 percent to about 5 percent of the aforementioned polyester in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns in average volume diameter, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Examples of modified polyester resins preferably with hydrophobic end groups that can be selected are as illustrated by the invention formulas provided herein, and include polyesters with siloxane end groups, such as poly(1,2-propylene diethylene terephthalate) γ-propyldimethylsiloxane, poly(1,2-propylene terephthalate) γ-propyldimethylsiloxane, poly(propoxylated bisphenol A fumarate) γ-propyldimethylsiloxane, poly(propoxylated bisphenol-succinate) γ-propyldimethylsiloxane, poly(propoxylated bisphenol-adipate) γ-propyldimethylsiloxane, poly(propoxylated bisphenol A-dodecylsuccinate) γ-propyldimethylsiloxane, poly(propoxylated bisphenol A-terephthalate-fumarate) γ-propyldimethylsiloxane, mixtures thereof, and the like; polyesters with silane end groups such as poly(1,2-propylene diethylene terephthalate)-trimethylsilane, (1,2-propylene diethylene terephthalate)-triethylsilane, poly(propoxylated bisphenol-adipate)-trimethylsilane, poly(propoxylated bisphenol A-dodecylsuccinate) trimethylsilane, and poly(propoxylated bisphenol A-terephthalate-fumarate) trimethylsilane; polyesters with fluorocarbon end groups such as poly(1,2-propylene diethylene terephthalate)-trifluoroacetyl, (1,2-propylene diethylene terephthalate)-trichloroacetyl, poly(propoxylated bisphenol-adipate)-trifluoroacetyl, poly(propoxylated bisphenol A-dodecylsuccinate)-trifluoroacetyl, and poly(propoxylated bisphenol A-terephthalate-fumarate)-trifluoroacetyl; polyesters with halocarbon end groups such as poly(1,2-propylene diethylene terephthalate)trichloroacetyl, (1,2-propylene diethylene terephthalate)-trichloroacetyl, poly(propoxylated bisphenol-adipate)-trifluoroacetyl, poly(propoxylated bisphenol A-dodecylsuccinate)-trichloroacetyl, mixtures thereof, and the like; and which polyesters display a number average molecular weight of from about 2,000 grams per mole to about 100,000 grams per mole, a weight average molecular weight of from about 4,000 grams per mole to about 250,000 grams per mole and polydispersity of from about 1.8 to about 5, as measured by gel permeation chromatography.

The modified polyester resins with hydrophobic end groups selected for the toner and developer compositions of the present invention, such as the poly(1,2-propylene diethylene terephthalate) γ-propyldimethylsiloxane, can be prepared by charging a 1 liter Parr reactor equipped with a mechanical stirrer and side condenser, a mixture of from about 0.9 to about 0.95 mole of diester, such as dimethylterephthalate, from about 1.75 mole to about 1:85 moles of a diol, such as 1,2-propanediol or diethylene glycol or mixtures thereof, from about 0.15 to about 0.3 mole of diethylene glycol, from about 0.01 to about 0.1 mole percent of γ-propyldimethylsiloxane, and from about 0.01 mole to about 0.05 mole of a known condensation catalyst such as butyltin oxide. The reactor is subsequently heated to 170° C. for a duration of from about 360 minutes to about 720 minutes with stirring at from about 10 revolution per minute to about 200 revolution per minute. During this time, from about 1.7 moles to about 2.0 moles of methanol byproduct can be collected through the condenser. The reactor temperature is then increased to about 200° C., and the pressure is reduced to about 1 millibarr over from about a 2 hour to about a 3 hour period. The polymeric resin, such as poly(1,2-propylene diethylene terephthalate) γ-propyldimethylsiloxane, is then discharged through the bottom of the reactor and cooled to room temperature.

Specific examples of diols utilized in preparing the aforementioned polyesters include ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, 1,2-hexylene glycol, 1,3-hexylene glycol, 1,4-hexylene glycol, 1,5-hexylene glycol, 1,6-hexylene glycol, heptylene glycols, octylene glycols, decalyne glycol, dodecylyne glycol, 2,2-dimethyl propanediol, propoxylated bisphenol A, ethoxylated bisphenol A, 1,4-cyclohexane diol, 1,3-cyclohexane diol, 1,2-cyclohexane diol, 1,2-cyclohexane dimethanol, 2-propanediol, mixtures thereof, and the like; and these glycols are employed in various effective amounts of, for example, from about 45 to about 55 mole percent by weight of the polyester product resin.

Specific examples of diacids or diesters utilized in preparing the aforementioned polyesters include malonic acid, succinic acid, 2-methyl succinic acid, 2,3-dimethylsuccinic acid, dodecylsuccinic acid, glutaric acid, adipic acid, 2-methyladipic acid, pimelic acid, azeilic acid, sebacic acid, terephthalic acid, isophthalic acid, phthalic acid, 1,2-cyclohexanedioic acid, 1,3-cyclohexanedioic acid, 1,4-cyclohexanedioic acid, glutaric anhydride, succinic anhydride, dodecylsuccinic anhydride, maleic anhydride, fumaric acid, maleic acid, itaconic acid, 2-methylitaconic acid, dialkyl esters, wherein the alkyl groups are of one carbon chain to 23 carbon chains, and are esters of malonate, succinate, 2-methylsuccinate, 2,3-dimethylsuccinate, dodecylsuccinate, glutarate, adipic acid, 2-methyladipate, pimelate, azeilate, sebacate acid, terephthalate, isophthalate, phthalate, 1,2-cyclohexanedioate, 1,3-cyclohexanedioate, 1,4-cyclohexanedioate, mixtures thereof, and which component is employed in effective amounts of, for example, from about 45 to about 55 mole percent by weight of the resin.

Specific examples of polycondensation catalysts can include tetraalkyl titanates, dialkyltin oxide, tetraalkyltin, dialkyltin oxide hydroxide, aluminum alkoxides, alkyl zinc, dialkyl zinc, zinc oxide, stannous oxide, dibutyltin oxide, butyltin oxide hydroxide, tetraalkyl tin, such as dibutyltin dilaurate, and mixtures thereof, and which catalysts are selected in effective amounts of from about 0.01 mole percent to about 1 mole percent of polyester product resin.

Examples of hyrophobic monomers, which can be utilized in preparing the aforementioned polyesters with hydrophobic end groups, include siloxanes, such as γ-propyldimethylsiloxane with an average molecular weight of from about 250 grams per mole to about 10,000 grams per mole, silanes such as trimethylsilane, triethylsilane, tripropylsilane, tributylsilane, triphenylsilane, t-butyldimethylsilane, t-butyldiphenylsilane, chlorotrimethylsilane, hexamethyldisilazane, chlorotriethylsilane, chlorotributylsilane, fluorocarbons such as trifluoroacetic acid, trifluoroacetic anhydride, trifluoroacetylchloride, pentafluoroethanol, 2-fluorethanol, 2-fluorophenethyl alcohol, 4-fluorophenethyl alcohol, 9-fluorenemethanol, halogenated carbons such as chloroethanol, bromoethanol, chloropropanol, chlorobutanol, chloropentanol, chlorohexanol, trichloroacetic acid, trichloroacetic anhydride, tribromo acetic acid, tribromoacetylbromide, chlorophenethyl alcohol, fluoropropanol, fluorobutanol, trifluoromethanol, fluoromethanol, fluorophenol, mixtures thereof, and the like; and which components can be employed in effective amounts of, for example, from about 0.001 mole percent to about 0.04 mole percent of the polyester product resin.

Numerous well known suitable pigments or dyes can be selected as the colorant for the toner particles including, for example, carbon black like REGAL 330®, nigrosine dye, aniline blue, phthalocyanines, magnetite, or mixtures thereof. A number of carbon blacks available from, for example, Cabot Corporation can be selected. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition.

When the pigment particles are comprised of magnetites, thereby enabling single component magnetic toners in some instances, which magnetites are a mixture of iron oxides ($FeO.Fe_2O_3$) including those commercially available as MAPICO BLACK™, they are present in the toner composition in an amount of from about 10 percent by weight to about 80 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK™, in an amount of, for example, from about 5 to about 60, and preferably from about 10 to about 50 weight percent can be selected.

There can also be blended with the toner compositions of the present invention other toner additives, such as external additive particles including flow aid additives, which additives are usually present on the surface thereof. Examples of these additives include metal oxides like titanium oxide, tin oxide, mixtures thereof, and the like, colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with known charge additives, such as quaternary ammonium salts, DDAMS, alkylpyridinium halides, BONTROL E-88™, bisulfates, and the like, reference U.S. Pat. Nos. 4,904,762; 4,883,736; 4,758,493; 4,430,040; 4,845,003 and 5,114,821, the disclosures of which are totally incorporated herein by reference, in an amount of from about 1 to about 30 weight percent and preferably 10weight percent, followed by the addition thereof to the toner in an amount of from 0.1 to 10 and preferably 0.1 to 1 weight percent.

Encompassed within the scope of the present invention are colored toner and developer compositions comprised of toner resin particles illustrated herein, and optional carrier particles, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In embodiments, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative or positive polarity enabling the toner particles, which are oppositely charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances, such as carbon black, in an amount of from about 5 to about 30 percent by weight. Polymer coatings not in close proximity in the triboelectric series can also be selected, reference U.S. Pat. Nos. 4,937, 166 and 4,935,326, the disclosures of which are totally incorporated herein by reference, including, for example, KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 and preferably from about 75 to about 200 microns in diameter thereby permitting them to, for example, possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier are selected.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the objectives of the present invention are achievable.

The toner compositions are usually jetted and classified subsequent to preparation to enable toner particles with a preferred average diameter of from about 5 to about 25 microns, and more preferably from about 8 to about 12 microns. Also, the toner compositions of the present invention preferably possess a triboelectric charge of from about 0.1 to about 2 femtocoulombs per micron in embodiments thereof as determined by the known charge spectrograph. Admix time for the toners of the present invention are preferably from about 5 seconds to 1 minute, and, more specifically, from about 5 to about 15 seconds in embodiments thereof as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

The following Examples are being supplied to further define various species of the present invention, it being noted that these Examples are intended to illustrate and not limit the scope of the present invention. Parts and percentages are by weight unless otherwise indicated. Comparative data are also provided.

COMPARATIVE EXAMPLE I

A toner composition comprised of 98 percent by weight of the linear poly(1,2-propylene-terephthalate) resin with hydroxyl end groups and with a diethylene/1,2-propylene ratio of 18.8:81.2, and 2 percent by weight of PV FAST BLUE™ pigment was prepared as illustrated in U.S. Pat. No. 5,391,452, the disclosure of which is totally incorporated herein by reference, see (Example XIX).

In a one liter Parr reactor equipped with a bottom drain valve, double turbine agitator, and distillation receiver with a cold water condenser were charged 375 grams of dimethylterephthalate, 268.9 grams of 1,2-propanediol (1 mole excess), 38.9 grams of diethylene glycol and 0.8 gram of tetrabutyl titanate as the catalyst. The reactor was then heated to 165° C. with stirring for 16 hours whereby 115 grams of distillate was collected in the distillation receiver comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced over a one hour period to about 260 Torr, and then reduced to 5 Torr over a two hour period with collection of approximately 126 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 14 grams of 1,2-propanediol was collected. The reactor was then purged with nitrogen to atmospheric pressure, and the polymer discharged through the bottom drain onto a container cooled with dry ice to yield 460 grams of poly(1,2-propylene-diethylene-terephthalate) resin. The resin glass transition temperature was then measured to be 56° C. (onset) utilizing the 910 Differential Scanning Calorimeter available from E. I. DuPont operating at a heating rate of 10° C. per minute. The number average molecular weight was measured to be 2,610 grams per mole and the weight average molecular weight was measured to be 6,800 grams per mole using tetrahydrofuran as the solvent, and obtained with the 700 Satelite WISP gel permeation chromatograph, available from Waters Company, and equipped with a styrogel column. 1.8 Grams of the poly(1,2-propylene-diethylene-terephthalate) resin was then pressed into a pellet of about 1 centimeter in diameter and about 10 centimeters in length using the press and die set supplied by Shimadzu with the Flowtester 500 series. The pressed sample pellet was then loaded in the flowtester and subjected to the standard Shimadzu conditions using 20 $Kg/cm^2$ load, and barrel temperature heated from 20° C. to 130° C. at a rate of 10° C. per minute. For the resin of this Example, a softening point of 76° C., beginning of flow temperature $T_1$ of 84° C., and flow temperature $T_2$ of 98° C. were obtained.

The resulting polymer was then fabricated into a cyan toner comprised of 98 percent of the above prepared polyester and 2 percent by weight of PV FAST BLUE™ using the procedure as reported in Example XVII of U.S. Pat. No. 5,391,452, the disclosure of which is totally incorporated herein by reference, that is mixing in an extruder the resin and pigment, or by the process of Example II that follows. After grinding, the toner was measured to display an average volume diameter particle size of 6.5 microns with a geometric distribution of 1.39 as measured by the Coulter Counter. The resulting toner was then utilized without further classification. For the toner of this Example, a softening point of 76° C., beginning of flow temperature $T_1$ of 84° C., and flow temperature $T_2$ of 98° C. were obtained as measured by the Shimadzu Flowtester. A developer composition was prepared by roll milling the aforementioned toner, 3 parts by weight with 100 parts by weight of carrier comprised of a steel core with polyvinylidene polymer coating (continuous and about 1.25 weight percent throughout unless otherwise noted) thereof. 50 Grams of the toner were then placed in a humidity control chamber at a 20 percent humidity level for 48 hours, and another 50 grams of the toner were placed in a humidity control chamber at 80 percent humidity level for 48 hours. The relative humidity sensitivity as calculated by Equation 1 for the toner of this Example was 2.8.

The humidity control chamber was custom made utilizing a plexiglass chamber equipped with a relative humidity meter manufactured by Electro-Tech Systems Incorporated. Two airflows were mixed in the chamber, wherein one airflow was passed through a container containing DRIERITE® available from Aldrich Chemical Company, and the other airflow was passed through water, and by changing the relative proportions of the two airflows a specific relative humidity was maintained and measured by the relative humidity meter.

The above control chamber was selected for all the Examples that follow.

EXAMPLE II

A toner composition comprised of 98 percent by weight of a similar base polyester of Comparative Example I, but with γ-propyldimethylsiloxane end groups was prepared. The poly(1,2-propylene-terephthalate) γ-propyldimethylsiloxane of this Example was prepared from a diethylene/1,2-propylene ratio of 18.8:81.2, and 0.04 weight percent of 3-hydroxypropyldimethylsiloxane, and the toner was prepared with 2 percent by weight of PV FAST BLUE™ pigment.

In a one liter Parr reactor equipped with a bottom drain valve, double turbine agitator and distillation receiver with a cold water condenser were charged with 375 grams of dimethylterephthalate, 268.9 grams of 1,2-propanediol (1 mole excess), 38.9 grams of diethylene glycol, 0.02 mole of bis(3-hydroxypropyl)dimethylsiloxane with a weight average molecular weight of 1,000, and 0.8 gram of tetrabutyl titanate as the catalyst. The reactor was then heated to 165° C. with stirring for 16 hours whereby 115 grams of distillate were collected in the distillation receiver comprised of about 98 percent by volume of methanol and 2 percent by volume of 1,2-propanediol as measured by the ABBE refractometer available from American Optical Corporation. The resulting mixture was then heated to 190° C. over a one hour period, after which the pressure was slowly reduced over a one hour period to about 260 Torr, and then reduced to 5 Torr over a two hour period with collection of approximately 126 grams of distillate in the distillation receiver comprised of approximately 97 percent by volume of 1,2-propanediol and 3 percent by volume of methanol as measured by the ABBE refractometer. The pressure was then further reduced to about 1 Torr over a 30 minute period whereby an additional 14 grams of 1,2-propanediol were collected. The reactor was then purged with nitrogen to atmospheric pressure, and the polymer discharged through the bottom drain onto a container cooled with dry ice to yield 450 grams of poly(1,2-propylene-diethylene-terephthalate) resin. The resin glass transition temperature was then measured to be 54° C. (onset) utilizing the 910 Differential Scanning Calorimeter available from DuPont operating at a heating rate of 10° C. per minute. The number average molecular weight was measured to be 3,910 grams per mole and the weight average molecular weight was measured to be 8,400 grams per mole using tetrahydrofuran as the solvent and determined with the 700 Satelite WISP gel permeation chromatograph, available from Waters Company equipped, with a styrogel column.

The resulting polymer was then fabricated into a cyan toner comprised of 98 percent of the above prepared polyester and 2 percent by weight of PV FAST BLUE™ by first grounding the aforementioned polyester to about 500 microns average volume diameter in a Model J Fitzmill equipped with an 850 micrometer screen. After grinding, 59 grams of the above prepared polyester polymer were mixed with 1 gram of PV FAST BLUE™ pigment. The two components were mixed utilizing a Black and Decker Coffee Grinder. The mixed components were then extruded utilizing the CS-194A twin screw extruder available from Custom Scientific Instruments at a barrel temperature of 140° C. An 8 inch Sturtevant micronizer was used to reduce the particle size further. After grinding, the toner was measured to display an average volume diameter particle size of 7.4 microns with a geometric distribution of 1.38 as measured by the Coulter Counter. The resulting toner was then utilized without further classification. A developer composition was prepared by roll milling the aforementioned toner, 3 parts by weight with 100 parts by weight of carrier comprised of a steel core with polyvinylidene polymer coating (continuous and about 1.25 weight percent throughout unless otherwise noted) thereof. 50 Grams of the toner were then placed in the custom made humidity laboratory control chamber at 20 percent humidity level for 48 hours, and another 50 grams were placed in the humidity control chamber at 80 percent humidity level for 48 hours. The relative humidity sensitivity as calculated by Equation 1 for the toner of this Example was 1.8. By reducing the hydrophillic end groups of the comparative Example I with the inventive γ-propyldimethylsiloxane end group of this Example: II, there was provided a reduced relative humidity sensitivity of from 2.8 to 1.8.

EXAMPLE III

A toner composition comprised of 98 percent by weight of a similar base polyester of Comparative Example I, but with trifluoroacetyl end groups was prepared. The poly(1,2-propylene-terephthalate) of Example I was reacted with 5 percent by weight of trifluoroacetic anhydride, and a toner was prepared with 2 percent by weight of PV FAST BLUE™ pigment.

A 500 milliliter flask equipped with a mechanical stirrer was charged with 75 grams of the poly(1,2-propylene-diethylene-terephthalate) of Example I, 300 milliliters of tetrahydrofuran, and 5 grams of triethylamine. To this stirred mixture was then added dropwise a solution of trifluoroacetic anhydride (3.75 grams) in 10 milliliters of tetrahydrofuran. The mixture was then left undisturbed for about 3 hours, and then poured into 3 liters of water. The precipitate was then filtered off and dried. The product (70 grams), poly(propylene-diethylene- terephthalate)-trifluoroacetate, was found to display a glass transition temperature measured to be 54° C. (onset) utilizing the 910 Differential Scanning Calorimeter available from I. E. DuPont operating at a heating rate of 10° C. per minute. The product number average molecular weight was measured to be 2,700 grams per mole, and the weight average molecular weight was measured to be 6,900 grams per mole using tetrahydrofuran as the solvent and determined with the 700 Satelite WISP gel permeation chromatograph, available from Waters Company, equipped with a styrogel column.

The resulting polymer was then fabricated into a cyan toner comprised of 98 percent of the above prepared polyester and 2 percent by weight of PV FAST BLUE™ using the same procedure as illustrated in Example II. After grinding, the toner was measured to display an average volume diameter particle size of 7.8 microns with a geometric distribution of 1.38 as measured by the Coulter Counter. The resulting toner was then utilized without further classification. A developer composition was prepared by roll milling the aforementioned toner, 3 parts by weight with 100 parts by weight of carrier comprised of a steel core with polyvinylidene polymer coating (continuous and about 1.25 weight percent throughout unless otherwise noted) thereof. 20 Grams of the toner were then placed in the humidity control chamber at 20 percent humidity level for 48 hours, and another 20 grams were subjected to the humidity control chamber at 80 percent humidity level for 48 hours. The relative humidity sensitivity as calculated by Equation 1 for the toner of this Example was 1.5. By reducing the hydrophillic end groups of the comparative Example I with the inventive trifluoroacetyl end groups of this Example III, there was provided a reduced relative humidity sensitivity of from 2.8 to 1.5.

COMPARATIVE EXAMPLE IV

A toner composition comprised of 98 percent by weight of a polyester resin derived from propoxylated bisphenol A and fumaric acid, available from Resena Chemical Company, with 2 percent by weight of PV FAST BLUE™ pigment was prepared as follows:

In a one liter Parr reactor equipped with a bottom drain valve, double turbine agitator and distillation receiver with a cold water condenser were charged with 344 grams of propoxylated bisphenol A, 116 grams of fumaric acid, 110 milligrams of hydroquinone and 0.4 gram of tetrabutyl titanate as the catalyst. The reactor was then heated to 165° C. with stirring for 6 hours whereby water was collected in the distillation receiver. The mixture was then heated to 190° C. over a one hour period, after which the pressure was slowly reduced over a one hour period to about 260 Torr, and then reduced to 5 Torr over a two hour period with collection of water in the distillation receiver. The reactor was then purged with nitrogen to atmospheric pressure, and the polymer discharged through the bottom drain onto a container cooled with dry ice to yield 380 grams of poly(propoxylated bisphenol A-fumarate) resin. The resin glass transition temperature was then measured to be 53° C. (onset) utilizing the 910 Differential Scanning Calorimeter available from DuPont operating at a heating rate of 10° C. per minute. The number average molecular weight was measured to be 6,910 grams per mole and the weight average molecular weight was measured to be 13,400 grams per mole using tetrahydrofuran as the solvent and determined with the 700 Satelite WISP gel permeation chromatograph, available from Waters Company, equipped with a styrogel column.

The resulting polymer was then fabricated into a cyan toner comprised of 98 percent of the above prepared polyester and 2 percent by weight of PV FAST BLUE™ using the same procedure as illustrated in Example II. After grinding, the toner was measured to display an average volume diameter particle size of 7.0 microns with a geometric distribution of 1.36 as measured by the Coulter Counter. The resulting toner was then utilized without further classification. A developer composition was prepared by roll milling the aforementioned toner, 3 parts by weight with 100 parts by weight of carrier comprised of a steel core with polyvinylidene polymer coating (continuous and about 1.25 weight percent throughout unless otherwise noted) thereof. 20 Grams of the toner were then subjected to the humidity control chamber at 20 percent humidity level for 48 hours, and another 20 grams were placed in the humidity control chamber at 80 percent humidity level for 48 hours. The relative humidity sensitivity as calculated by Equation 1 for the toner of this Example was 3.5.

EXAMPLE V

A toner composition comprised of 98 percent by weight of the polyester resin of Example IV, and with trifluoroacetyl end groups, and 2 percent by weight of PV FAST BLUE™ pigment was prepared as follows.

A 500 milliliter flask equipped with a mechanical stirrer was charged with 75 grams of the poly(propoxylated bisphenol A-fumarate) available from Resena Chemical Company (Brazil), 300 milliliters of tetrahydrofuran, and 5 grams of triethylamine. To this stirred mixture was then added dropwise a solution of trifluoroacetic anhydride (3.75 grams) in 10 milliliters of tetrahydrofuran. The mixture was then left undisturbed for about 3 hours, and then poured into 3 liters of water. The precipitate was then filtered off and dried. The product (72 grams), poly(propoxylated bisphenol A-fumarate)-trifluoroacetate, was found to display a glass transition temperature measured to be 53° C. (onset) utilizing the 910 Differential Scanning Calorimeter, available from E. I. DuPont, operating at a heating rate of 10° C. per minute. The number average molecular weight was measured to be 3,900 grams per mole and the weight average molecular weight was measured to be 11,000 grams per mole using tetrahydrofuran as the solvent and obtained with the 700 Satelite WISP gel permeation chromatograph, available from Waters Company, equipped with a styrogel column.

The resulting above prepared polyester polymer was then fabricated into a cyan toner comprised of 98 percent of the above prepared polyester and 2 percent by weight of PV FAST BLUE™ using the same procedure as illustrated in Example II. After grinding, the toner was measured to display an average volume diameter particle size of 7.2 microns with a geometric distribution of 1.38 as measured by the Coulter Counter. The resulting toner was then utilized without further classification. A developer composition was prepared by roll milling the aforementioned toner, 3 parts by weight with 100 parts by weight of carrier comprised of a steel core with polyvinylidene polymer coating (continuous and about 1.25 weight percent throughout unless otherwise noted) thereof. 20 Grams of the toner were then placed and tested in a humidity control chamber at 20 percent humidity level for 48 hours, and another 20 grams were placed and tested in a humidity control chamber at 80 percent humidity level for 48 hours. The relative humidity sensitivity as calculated by Equation 1 for the toner of this Example as 2.5. By reducing the hydrophillic end groups of the comparative Example IV with the inventive trifluoroacetyl end groups end group of this Example V, there was provided a reduced relative humidity sensitivity of from 3.5 to 2.5.

Other embodiments and modifications of the present invention may occur to those skilled in the art subsequent to a review of the information presented herein; these embodiments and modifications, as well as equivalents thereof, are also included within the scope of this invention.

What is claimed is:

1. A toner composition consisting essentially of pigment, an optional charge enhancing additive, optional wax, and a polyester resin containing a hydrophobic end group, which polyester is free of acid end groups and is of the formula

I

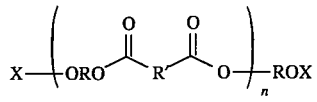

or

II

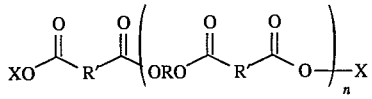

wherein R is an alkylene group, an alkyleneoxylated bisphenol, or a cyclohexylene; R' is an aryl group an olefinic group, or an alkylene group; X is an hydroxyalkylsiloxane; and n represents the number of segments.

2. A toner composition in accordance with claim 1 wherein R contains from 2 to about 45 carbon atoms; the alkyleneoxylated bisphenol contains from 1 to about 25 carbon atoms; and R' arylene contains from 6 to about 30 carbon atoms; and wherein the polyester resin is present in an amount of from about 70 to about 90 weight percent, the pigment is present in an amount of from about 2 to about 10 percent; the charge additive is present is an amount of from about 0.05 to about 5 percent, and the wax is present in an amount of from about 0.1 to about 10 percent.

3. A toner composition in accordance with claim 1 wherein the alkyleneoxylated bisphenol is propyloxylated bisphenol A, or ethoxylated bisphenol A; the cyclohexylene is 1,4-dimethyl cyclohexylene, 1,3-dimethyl cyclohexylene, or 1,2-dimethyl cyclohexylene; R' is the aryl group 1,4-phenylene, 1,3-phenylene, 1,2-phenylene, or benzylene; the olefinic group is methylvinylene, ethylene, propylene, butylene, pentylene, hexylene, heptylene, octylene, or 2-decylethylene; X is the silane group trimethylsilyl, triethylsilyl, or the siloxane dimethylsiloxane of molecular weight of from about 200 to about 20,000 grams per mole; and said halogenated hydrocarbon is the fluorinated hydrocarbon trifluoromethyl, pentafluoroethyl, octafluoropentyl, tribromomethyl, trichloromethyl, 2-chloroethyl, 1-chlorohexyl, chloroheptyl, or 2-chlorooctyl.

4. A toner composition in accordance with claim 1 wherein the hydrophobic end group polyester is poly(1,2-propylene diethylene terephthalate) γ-propyldimethylsiloxane, poly(1,2-propylene terephthalate) γ-propyldimethylsiloxane, poly(propoxylated bisphenol-fumarate) γ-propyldimethylsiloxane, poly(propoxylated bisphenol-succinate) γ-propyldimethylsiloxane, poly(propoxylated bisphenol-adipate) γ-propyldimethylsiloxane, poly(propoxylated bisphenol A-dodecylsuccinate) γ-propyldimethylsiloxane, poly(propoxylated bisphenol A-terephthalate-fumarate) γ-propyldimethylsiloxane, poly(1,2-propylene diethylene terephthalate)-trimethylsilane, (1,2-propylene diethylene terephthalate)-triethylsilane, poly(propoxylated bisphenol-adipate)-trimethylsilane, poly(propoxylated bisphenol A-dodecylsuccinate) trimethylsilane, poly(propoxylated bisphenol A-terephthalate-fumarate) trimethylsilane, poly(1,2-propylene diethylene terephthalate)-trifluoroacetyl, (1,2-propylene diethylene terephthalate)-trifluoroacetyl, poly(propoxylated bisphenol-adipate)-trifluoroacetyl, poly(propoxylated bisphenol A-dodecylsuccinate)-trifluoroacetyl, poly(propoxylated bisphenol A-terephthalate-fumarate)-trifluoroacetyl, poly(1,2-propylene diethylene terephthalate)-trichloroacetyl, (1,2-propylene diethylene terephthalate)-trichloroacetyl, poly(propoxylated bisphenol-adipate)-trifluoroacetyl, poly(propoxylated bisphenol A-dodecylsuccinate)-trichloroacetyl, or mixtures thereof.

5. A toner composition in accordance with claim 1 wherein the polyester resin possesses a number average molecular weight of from about 2,000 grams per mole to about 100,000 grams per mole, a weight average molecular weight of from about 4,000 grams per mole to about 250,000 grams per mole, and polydispersity of from about 1.8 to about 5.

6. A toner composition in accordance with claim 1 with a relative humidity of from about 1.0 to about 2.5, and preferably from about 1.1 to about 2.2.

7. A toner composition in accordance with claim 1 wherein a positive or negative charge enhancing additive is present in an amount of from about 0.05 to about 5 weight percent.

8. A toner composition in accordance with claim 1 wherein the charge additive is incorporated into the toner, or is present on the surface of the toner composition.

9. A toner composition in accordance with claim 1 with an admix time of from about 30 to about 60 seconds.

10. A toner composition in accordance with claim 1 containing a wax component with a weight average molecular weight of from about 1,000 to about 20,000.

11. A toner composition in accordance with claim 9 wherein the wax component is selected from the group consisting of polyethylene and polypropylene.

12. A toner composition in accordance with claim 1 containing as external additives metal salts of a fatty acid, colloidal silicas, metal oxides, or mixtures thereof.

13. A toner composition in accordance with claim 1 wherein the pigment is carbon black, magnetites, or mixtures thereof, cyan, magenta, yellow, red, blue, green, brown, and mixtures thereof.

14. A developer composition comprised of the toner composition of claim 1 and carrier particles.

15. A method of imaging which comprises formulating an electrostatic latent image on a negatively charged photoreceptor, affecting development thereof with a toner composition consisting essentially of pigment, an optional charge enhancing additive, optional wax, and a polyester resin containing a hydrophobic end group, which polyester is free of acid end groups and is of the formula

I

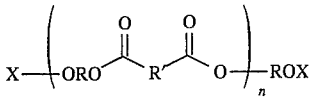

or

II

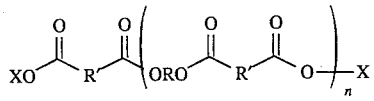

wherein R is an alkylene group, an alkyleneoxylated bisphenol, or a cyclohexylene; R' is an aryl group, an olefinic group, or an alkylene group; X is an hydroxyalkylsiloxane; and n represents the number of segments, and thereafter transferring the developed image to a suitable substrate.

16. A method of imaging in accordance with claim 15 wherein the transferred image is permanently fixed to the substrate.

17. A toner in accordance with claim 1 wherein the charge additive is a quaternary ammonium compound.

18. A toner in accordance with claim 1 wherein the charge additive is cetyl pyridinium halide, or distearyl dimethyl ammonium methyl sulfate.

19. A toner in accordance with claim 1 wherein X is a fluorocarbon, and n is a number of from about 10 to about 5,000.

20. A toner in accordance with claim 1 with a positive or negative triboelectrical charge of from about 10 to about 55 microcoulombs per gram.

21. A toner composition comprised of pigment, a charge enhancing additive, wax, and a polyester resin containing a hydrophobic end group, which polyester is free of acid end groups and is of the formula

I

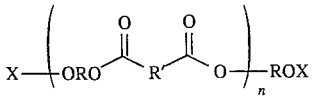

or

II

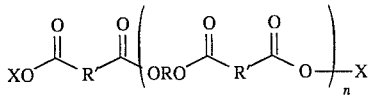

wherein R is an alkylene group, an alkyleneoxylated bisphenol, or a cyclohexylene; R' is an aryl group, an olefinic group, or an alkylene group; X is an hydroxyalkylsiloxane; or a halogenated hydrocarbon; and n represents the number of segments.

* * * * *